US006853343B2

(12) United States Patent
McCandless et al.

(10) Patent No.: US 6,853,343 B2
(45) Date of Patent: Feb. 8, 2005

(54) POLARIZATION PLATE

(75) Inventors: Jay H. McCandless, Renton, WA (US); Charles R. Bragg, Kirkland, WA (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/075,387

(22) Filed: Feb. 15, 2002

(65) Prior Publication Data

US 2002/0080079 A1 Jun. 27, 2002

Related U.S. Application Data

(63) Continuation of application No. 09/267,251, filed on Mar. 12, 1999, now abandoned.

(51) Int. Cl.[7] ..... H01Q 19/00; H01P 5/12

(52) U.S. Cl. ..... 343/756; 343/772; 333/21 A; 333/254

(58) Field of Search ..... 343/756, 786; 333/21 A, 256, 257, 254

(56) References Cited

U.S. PATENT DOCUMENTS

| | | | | | |
|---|---|---|---|---|---|
| 2,611,087 | A | * | 9/1952 | Alford | 343/786 |
| 2,628,278 | A | * | 2/1953 | Zaleski | 333/21 A |
| 2,975,383 | A | * | 3/1961 | Seling | 333/21 A |
| 3,778,838 | A | * | 12/1973 | Clavin | 343/727 |
| 3,919,670 | A | * | 11/1975 | Klein | 333/21 A |
| 4,065,772 | A | * | 12/1977 | Seavey | 343/756 |
| 4,087,746 | A | * | 5/1978 | Kanae | 333/21 A |
| 4,311,973 | A | * | 1/1982 | Nuding et al. | 333/21 A |
| 4,353,041 | A | * | 10/1982 | Bryans et al. | 333/21 A |
| 4,772,893 | A | * | 9/1988 | Iwasaki | 343/779 |
| 5,364,136 | A | * | 11/1994 | Forti et al. | 333/254 |

* cited by examiner

*Primary Examiner*—Michael C. Wimer
(74) *Attorney, Agent, or Firm*—Duane Morris LLP

(57) ABSTRACT

The present invention discloses a system and method by which radio transceiver equipment may be coupled to antenna equipment polarized in either of two orthogonal polarizations without requiring any adaptation or additional componentry while providing the same signal path attributes irrespective of the polarization chosen. Accordingly, a single transceiver/antenna unit may be utilized for providing communications polarized vertically, or slant right, and polarized horizontally, or slant left.

17 Claims, 4 Drawing Sheets

POLARIZATION PLATE

RELATED APPLICATIONS

This application is a continuation of application Ser. No. 09/267,251 filed Mar. 12, 1999 now abandon for "Polarization Plate".

The present application is related to co-pending and commonly assigned U.S. Pat. No. 6,016,313, entitled "System and Method for Broadband Millimeter Wave Data Communications" filed Nov. 7, 1996, concurrently filed, co-pending and commonly assigned U.S. Pat. No. 6,573,808, entitled "Millimeter Wave front End" and concurrently filed, co-pending and commonly assigned U.S. Pat. No. 6,342,870, entitled "Antenna Frame Structure Mounting and Alignment, the disclosures of which are incorporated herein by reference."

TECHNICAL FIELD OF THE INVENTION

The present invention relates generally to systems adaptable for the transmission of radio frequency signals having a desired polarization and more particularly to a dual polarization system coupled to a single polarization waveguide.

BACKGROUND OF THE INVENTION

Information communication is often accomplished at least in part through the transmission of radio frequency energy modulated to carry the desired information. In order to communicate such information across physical gaps in a communication system infrastructure, air links are often utilized. Accordingly, radio waves having the aforementioned modulated information carried thereon may be broadcast or transmitted across these physical gaps for reception by communication infrastructure deployed at various physical locations.

For example, the above referenced patent application entitled "System and Method for Broadband Millimeter Wave Data Communications" discloses a communication system in which a communication hub is centrally located to provide an air link between a plurality of physically separated processor-based systems, or other sources of communication such as voice communication, each utilizing a communication node. The communication spectrum utilized by the communication system may be frequency division multiplexed (FDM) to provide multiple channels for simultaneous information communication to a plurality of subscribers or in order to provide spectrum for other services. For example, a carrier frequency in the millimeter wavelength (mmWave) spectrum, such as 10 to 60 GHz, may be used for information communication in order to provide a communication bandwidth sufficient for the transmission of approximately 30 Mbps through FDM channels of approximately 10 MHZ. However, it becomes readily apparent that the available spectrum may be fully occupied where large multiples of such channels are required.

The depletion of the available spectrum is often accelerated by such considerations as providing guard bands in order to avoid cross communication from adjacent channels and exclusion areas prohibiting reuse of particular channels in order to avoid co-channel interference. Accordingly other techniques of discriminating various information communication signals have been utilized.

For example, it may be advantageous to utilize differently polarized radio waves in order to discriminate between various communicated signals. Accordingly, a first communicated signal may have a first polarization, such as vertical or slant right, and a second communicated signal may have a second, preferably orthogonal, polarization, such as horizontal or slant left. Using such a technique, it is possible to provide additional communication bandwidth as the communication signals having substantially orthogonal polarization may be isolated through the use of properly polarized receiving apparatus, such as polarized antennas.

However, it should be appreciated that the use of polarization introduces additional complexity into the circuitry of the communication infrastructure. For example, variously polarized antenna structures are generally required instead of a single antenna configuration for non-polarized systems. Additionally, especially where mmWave frequencies are utilized, transceiver equipment may require physical adaptation to accommodate variously polarized antennas, such as to include waveguides properly polarized to accept an antenna having a desired polarization. Accordingly, the use of orthogonal polarization can require multiple variations in the equipment utilized, causing inefficiencies in the manufacture and supplying of such equipment as multiple versions of the equipment must be manufactured and stocked, such as for new deployment and/or spares. Moreover, inefficiencies are realized in the servicing of such equipment as service technicians must ensure the proper matching of transceiver equipment, antenna, and deployment position in order to ensure that each are matched to accomplish the desired polarization communication.

Accordingly, a need exists in the art for the adapting of communication equipment for accepting information communication having any desired polarization. A further need exists in the art for a system and method providing for the acceptance of information communication having any desired polarization to utilize a single set of components regardless of the polarization utilized with a particular communication link.

SUMMARY OF THE INVENTION

These and other objects, features and technical advantages are achieved by a system and method which utilizes a system adapted to accept dual polarization. In the preferred embodiment of the present invention, a polarization plate is disposed in a waveguide coupling transceiver equipment with an associated antenna. Preferably, the polarization plate includes a section of waveguide rotated approximately 45° with respect to the axis of the waveguide as coupled to the transceiver equipment to a 45° rotation in the waves conducted there through. Accordingly, both an antenna having a polarization substantially consistent with that of the waveguide coupled to the transceiver equipment and an antenna having a polarization substantially orthogonal to that of the waveguide coupled to the transceiver equipment may be coupled to the polarization plate and the polarization rotated in steps of 45°.

In the preferred embodiment, the polarization plate provides a coupler which accepts antenna elements, or other communication equipment, in various orientations. Accordingly, a single antenna element, or other communication equipment, configuration may be utilized to provide each of the orthogonal polarizations utilized according to the present invention.

Moreover, although potentially causing some reflected waves due to the rotation of the waveguide, the preferred embodiment of the polarization plate is disposed to equally affect communicated signals of either polarization. Accordingly, regardless of which polarization is actually used, the componentry does not require any adjustment, either physically in order to couple the various components, or electrical in order to compensate, such as for attenuation, associated with a particular configuration.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE INVENTION

Figure 1:
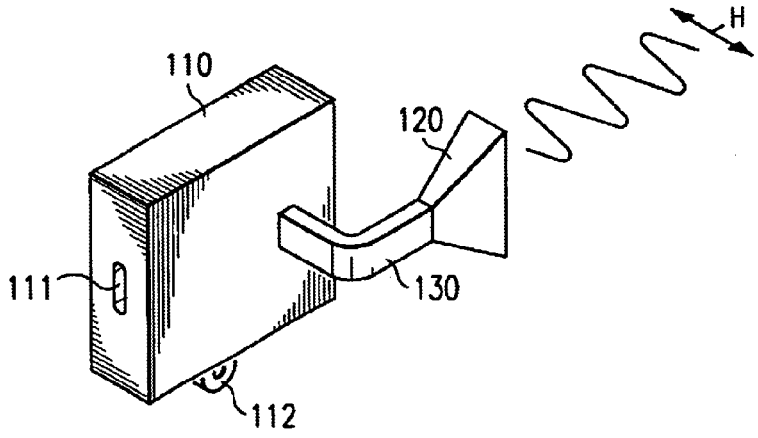
FIG. 1 shows a transceiver adapted to provide communications utilizing horizontally polarized radio waves.

Directing attention to FIG. 1, a transceiver and antenna assembly such as may be utilized to provide information communication via an air gap as radio frequencies in the range of 2 to 110 GHz is shown. Here transceiver unit 110 is coupled to antenna 120 via waveguide 130. Transceiver unit 110 may provide only a portion of the circuitry necessary to utilize the communicated information, such as the duplexing circuitry, filters, and up/down converters of the front end circuitry disclosed in the above referenced patent application entitled "Millimeter Wave Front End." Accordingly, transceiver unit 110 may include an electrical interface, such as connector 111, adapted to couple additional electronic circuitry to the transceiver unit. Additionally, transceiver unit 110 may include hardware, such as connector 112 disposed for the mounting of the transceiver unit and/or the coupled antenna.

It shall be appreciated that antenna 120 of FIG. 1 is adapted to provide communication of signals having a particular polarization, in this case vertical. Accordingly, waveguide 130 is specifically adapted to mate with antenna 120 and to pass waves polarized in the vertical plane. As such, in the embodiment illustrated in FIG. 1, the bend in wave guide 130 provided to direct the passed waves is an E-bend.

Figure 2:
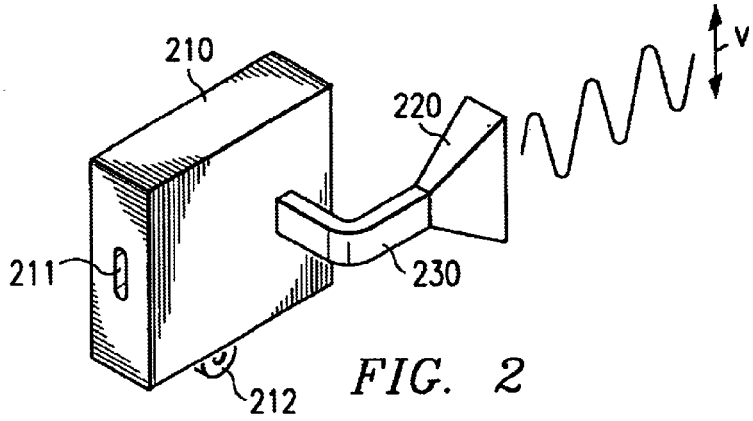
FIG. 2 shows a transceiver adapted to provide communications utilizing vertically polarized radio waves.

Directing attention to FIG. 2, a second transceiver and antenna assembly which may be utilized to provide information communication via an air gap is shown. Here transceiver unit 210 is coupled to antenna 220 via waveguide 230. Transceiver unit 210 is substantially the same as transceiver unit 110 and, accordingly, may provide only a portion of the circuitry necessary to utilize the communicated information. Accordingly, transceiver unit 210 may include an electrical interface, such as connector 211, adapted to couple additional electronic circuitry to the transceiver unit. Additionally, transceiver unit 210 may include hardware, such as connector 212 disposed for the mounting of the transceiver unit and/or the coupled antenna.

Antenna 220 of FIG. 2 is adapted to provide communication of signals having a polarization substantially orthogonal, in this case horizontal, to that of antenna 120 of FIG. 1. Accordingly, waveguide 230 is specifically adapted to mate with antenna 220 and to pass waves polarized in the horizontal plane. As such, in the embodiment illustrated in FIG. 2, the bend in wave guide 230 provided to direct the passed waves is an H-bend.

In comparing the embodiments of FIGS. 1 and 2 it becomes readily apparent that the transceiver/antenna combinations of both embodiments are substantially the same except for their difference in polarity. Accordingly, the entire units illustrated in FIGS. 1 and 2 are interchangeable in order to allow for selection of the polarization of the communicated signal.

For example, a first centralized communication hub as described in the above referenced patent application entitled "System and Method for Broadband Millimeter Wave Data Communications" could be populated with transceiver/antennas of FIG. 1 to provide vertically polarized communications within a first geographic area while a second centralized communication hub could be populated with transceiver/antennas of FIG. 2 to provide horizontally polarized communications within a second, adjacent, geographic area. Likewise, the centralized communication hub may be populated with ones of each polarization to provide discrimination between various communicated signals. Accordingly, the communication hub in each case, or portions of the communication hub coupled to the variously polarized transceiver/antenna modules, could be substantially the same having different transceiver/antenna modules.

However, this level of commonality between various installations of communication equipment still requires the manufacture and stocking of two embodiments of the transceiver units, connecting waveguides, and, potentially, the antennas, although each provides substantially the same functionality and may be coupled to a same or similar host. This is because of differences necessary to accommodate the differences in polarization. For example, the transceiver for each polarization includes componentry adapted to accept signals as communicated by waveguides having axises 90° displaced with respect to each other. Similarly, the waveguides must be adapted to allow the antenna to be disposed in the proper orientation in order to communicate a signal having the desired polarization while accommodating such physical considerations as mounting orientation and footprint.

Figure 3:
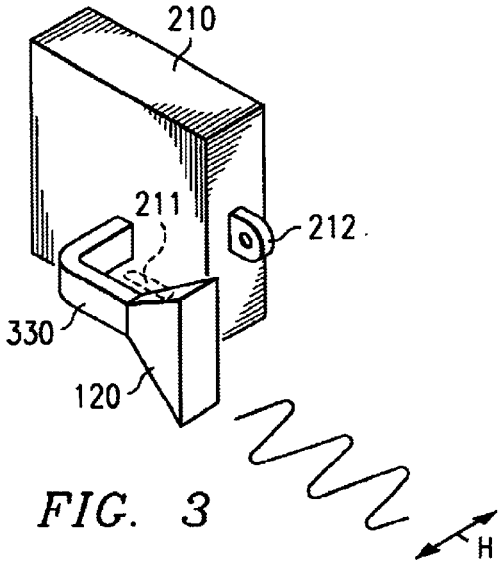
FIG. 3 shows the transceiver of FIG. 2 adapted to provide communications utilizing horizontally polarized radio waves.

Directing attention to FIG. 3, transceiver unit 210 of FIG. 2 is shown having an alternative waveguide 330 providing coupling of antenna 120 in order to provide vertically polarized communication with transceiver unit 210. Accordingly, in order to allow the portion of transceiver unit 210 adapted to accept vertically polarized waves to accept horizontally polarized waves, waveguide 330 is rotated 90° from that of waveguide 130. Accordingly, the bend in waveguide 330 is an H-bend rather than an E-bend as with waveguide 130.

It shall be appreciated that providing a waveguide with a bend along a particular axis, either an E-bend or an H-bend, may be preferred in certain circumstances. For example where the waveguide includes a solid dielectric, having particular transmission characteristics, it may be preferable to provide only E-bends in order to reduce undesired reflections or signal attenuation. Likewise, where a ridged waveguide is utilized to provide to extend the range of frequencies propagated through the waveguide, it may be advantageous to restrict waveguide bends to a particular type. Accordingly, in addition to allowing a same transceiver unit to be utilized for each orthogonal polarization, the embodiments of FIGS. 2 and 3 allow for common waveguide attributes to be utilized regardless of the polarization.

However, although the same transceiver unit may be utilized for both horizontal and vertical polarization in the embodiments of FIGS. 2 and 3, it may not be possible to conveniently deploy such embodiments. For example, directing attention to FIG. 3 it can be seen that rotation of the antenna in order to allow its coupling to a transceiver unit adapted for an orthogonal polarization may interfere with other aspects of the design. Specifically, antenna 120 in the embodiment of FIG. 3 is disposed in a position which may substantially interfere with the use of connector 212. Likewise, connector 211 is now disposed on a side of transceiver unit 210 rather than the back of transceiver unit 210 as in FIG. 2 and, therefore, may present complications in connecting the unit to other electronic circuitry.

Figure 4:
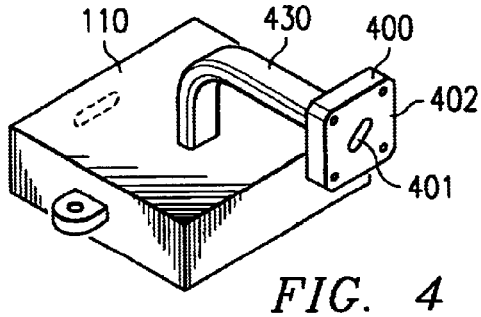
FIG. 4 shows a preferred embodiment of a dual polarization plate of the present invention.

Therefore the preferred embodiment of the present invention utilizes a dual polarization adaptor in order to allow either orthogonal polarization to be utilized at a single transceiver unit, or other communication equipment, without requiring reorientation of such equipment. As such, not only may common mounting techniques be utilized between the different polarized components, but so too may preferred characteristics be retained between these two configurations, such as the aforementioned maintaining of a particular band regardless of polarization. Directing attention to FIG. 4 transceiver 110 having waveguide 430 adapted to accept dual polarization according to a preferred embodiment of the present invention is shown. Here polarization plate 400 is coupled to waveguide 430. Polarization plate 400 includes waveguide portion 401 which is offset, or rotated, 45° with respect to the propagation axis of waveguide 430. Accordingly waveguide portion 401 is equally well suited for coupling with waveguides having propagation axises consistent with that of waveguide 430 and orthogonal to that of waveguide 430.

Figure 5A:
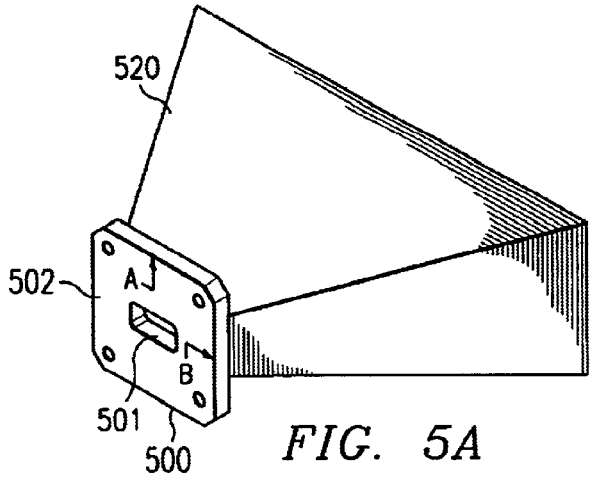
FIGS. 5A and 5B show a preferred embodiment of orthogonally polarized horn antennas adapted to couple to the polarization plate of FIG. 4.

Directing attention to FIG. 5A, polarized antenna 520, preferable for use at a point to multi point hub site because of its narrow beam capability for example, is illustrated having waveguide portion 501 consistent with the polarization of antenna 520 disposed in mounting plate 500. Accordingly, by placing face 502 of mounting plate 500 in juxtaposition with face 402 of polarization plate 400 such that arrow A is in the vertical orientation, a transceiver/antenna combination having vertical polarization as shown in FIG. 1 may be realized. Likewise, by placing face 502 of mounting plate 500 in juxtaposition with face 402 of polarization plate 400 such that arrow B is in the vertical orientation, a transceiver/antenna combination having horizontal polarization as shown in FIG. 2 may be realized. Accordingly, it shall be appreciated that this embodiment of the present invention may utilize exactly the same componentry to provide for both orthogonal polarizations. As such manufacturing and stocking such equipment is greatly simplified.

Figure 5B:
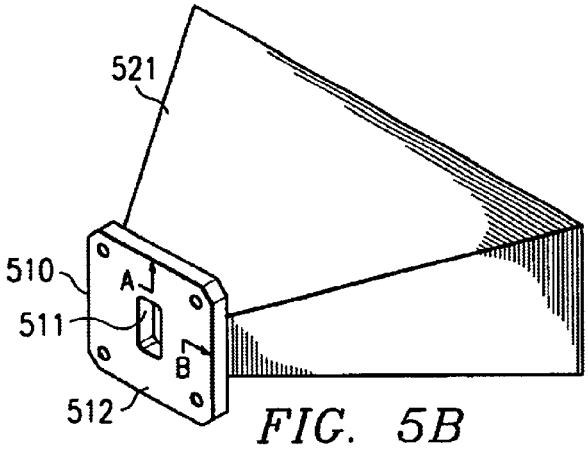

However, it should be appreciated that due to the characteristics of horn antenna 520 being asymmetric with respect to the axes of Arrow A and Arrow B, rotation of the antenna to provide orthogonal polarization may provide undesired results, such as unacceptable side lobes in one orientation or undesired beam width or height in one of the other orientations. Accordingly, a preferred embodiment of the present invention utilizes an orthogonally polarized antenna such as shown in FIG. 5B in order to provide dual polarization wherein the antenna beams for each such polarization are substantially similar. Accordingly, wave guide portion 511 consistent with the polarization of antenna 521 is disposed in mounting plate 510 in an orientation orthogonal to that of wave guide portion 501 of FIG. 5A. Therefore, by placing face 512 of mounting plate 500 in juxtaposition with face 402 of polarization plate 400 such that arrow A is in the vertical orientation horizontal polarization may be realized.

Of course, rather than utilizing antennas having asymmetric characteristics with respect to the axises of arrow A and arrow B, the present invention may utilize a symmetrical antenna suitable for use in multiple orientations, if desired. Directing attention to FIG. 5C a polarized dish antenna 530, preferable for use at a point to multi point subscriber site because of its increased gain capability for example, is illustrated having wave guide portion 541 disposed in mounting plate 540. Accordingly, by placing face 542 of mounting plate 540 in juxtaposition with face 402 of polarization plate 400 such that arrow A is in the vertical orientation, a transceiver/antenna combination having horizontal polarization may be realized. Likewise, by placing face 542 of mounting plate 540 in juxtaposition with face 402 of polarization plate 400 such that arrow B is in the vertical orientation, a transceiver/antenna combination having vertical polarization may be realized. Accordingly, this embodiment utilizes exactly the same componentry to provide for both orthogonal polarities while still maintaining consistent antenna beam characteristics in both polarizations.

Figure 5C:
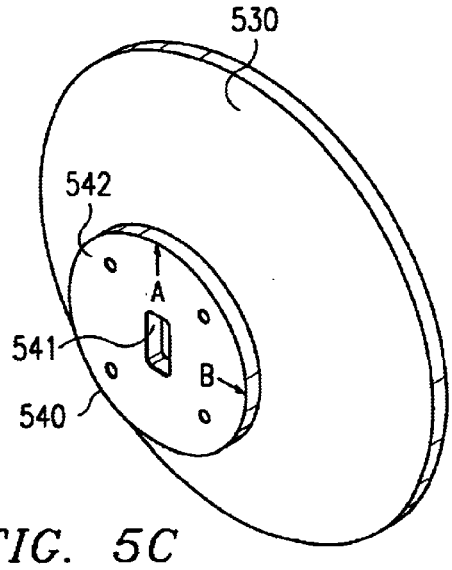
FIG. 5C shows a preferred embodiment of a dish antenna adapted to couple to the polarization plate of FIG. 4.

It shall be appreciated that rather than rotating the entire antenna assembly of FIG. 5C that only a portion of the assembly may be removed and rotated, if desired. For example, where dish antenna 530 includes a radome covering which is in a preferred orientation, such as due to a moisture drain hole being at a lowest point or graphics applied thereon being in a desired orientation, mounting plate 540, and its accompanying wave guide portion, may be removed for antenna 530 and rotated to a desired orientation.

It shall be appreciated that the transceiver unit, or other communication equipment, of the preferred embodiment is disposed in the same orientation regardless of the polarization utilized. Accordingly, installation and servicing of the equipment is simplified. Specifically, as the transceiver unit is disposed in a common orientation regardless of polarization, deploying such equipment on a mast or other platform is less problematic than were adaptations must be made depending on the polarization. Servicing is simplified as only one type of spare need be retained and properly deploying the spare when needed is as straight forward as ensuring the antenna is oriented properly.

Figure 6A:
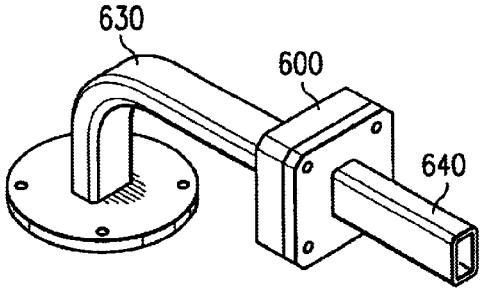
FIG. 6A shows a polarization plate of the present invention coupled to provide cross-polarization.
Figure 6B:
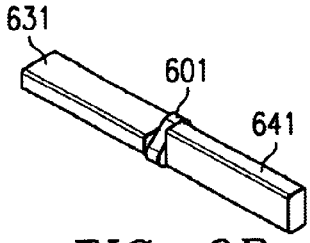
FIG. 6B illustrates the internal cavities of the waveguides of FIG. 6A.
Figure 7A:
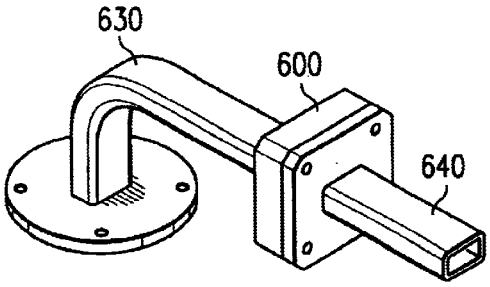
FIG. 7A shows a polarization plate of the present invention coupled to provide co-polarization.
Figure 7B:
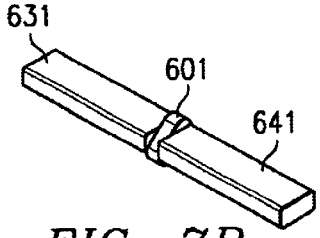
FIG. 7B illustrates the internal cavities of the waveguides of FIG. 7A.

Directing attention to FIGS. 6A and 7A, waveguides 630 and 640 are shown coupled through the use of a polarization plate 600 according to the present invention. Similar to polarization plate 400 of FIG. 4, polarization plate 600 includes a polarized slit, which may itself form a waveguide portion, which is rotated approximately 45° with respect to both waveguides 630 and 640. Accordingly, the interior cavity of waveguide 630, cavity 631 of FIGS. 6B and 7B, and the interior cavity of waveguide 640, cavity 641 of FIGS. 6B and 7B, are at a consistent offset with respect to the cavity of the slit, cavity 601 of FIGS. 6B and 7B. Specifically, in the embodiment of FIG. 6A, wherein the polarization of waveguide 630 is orthogonal to that of waveguide 640 (cross-polarized), each of waveguides 630 and 640 are offset approximately 45° with respect to the polarization plate slit as shown in FIG. 6B. Likewise, in the embodiment of FIG. 7A, wherein the polarization of waveguide 630 is consistent with that of waveguide 640 (co-polarized), each of waveguides 630 and 640 are offset approximately 45° with respect to the polarization plate slit as shown in FIG. 7B.

It should thus be appreciated that, irrespective of the particular choice of polarization of one waveguide with respect to the other, i.e., cross-polarized or co-polarized, the signal path presented by the preferred embodiment of the present invention presents common attributes. As such, circuitry does not need to be adjusted or tuned in order to present the same channel characteristics when either cross-polarized or co-polarized components are utilized.

However, as the polarization plate provides a junction and a transition in the polarization of the propagated waves, the polarization plate contributes to the energy dissipation in the waveguides. For example, in the preferred embodiment the slit or waveguide portion in the polarization plate is not tapered, i.e., face 402 of waveguide 400 is substantially flat having a slit disposed therein substantially the size of the desired interior waveguide cavity. Accordingly, a simple to manufacture component allows substantially the same propagation characteristics to be presented irrespective of the polarization of the mating signal path. Experimentation has revealed that such an embodiment does not reflect an intolerable amount of power in that the return loss has been experienced to be approximately 20 dB.

It should be appreciated that the polarization plate of the present invention may be a separate and distinct component of the signal path, i.e., a plate having a slit disposed therein which is independently coupled to both portions of signal path between which it is disposed. Accordingly, where the signal path is utilized for both forward and reverse links, a transition introducing an appreciable amount of energy dissipation into both the forward and reverse links.

However, an alternative embodiment of the present invention includes the polarization plate of the present invention as an integral part of a signal path to which it is coupled. Accordingly there may be a gentle rotation of the propagated wave from the polarization of this portion of the signal path into the 45° offset polarization associated with the polarization plate. For example, the polarization plate of FIG. 4 may include a portion of signal path which gently rotates the horizontally polarized waves to the 45° slant right polarization of the polarization plate. Accordingly the return loss associated with the introduction of the polarization plate in the signal path may be reduced in the forward or reverse links. This may be important such as where the received signal level is substantially attenuated but there is power available which may be lost due to reflection losses in the transmit link.

An alternative embodiment of the present invention provides a slit in the polarization plate adapted to reduce loss due to reflection over that of the substantially flat faced polarization plate discussed above. Directing attention to FIG. 8, polarization plate 800 is shown having slit 801 disposed in face 802 at approximately a 45° offset as described above. However, instead of presenting a substantially flat face as with face 402 of FIG. 4, face 802 includes tapered areas 810, 811, 820, and 821, such as may be milled into the polarization plate, to provide a more subtle change in polarization to the propagated waves. Tapered areas 810 and 811 are provided for use by a vertically polarized signal path portion to be coupled to polarization plate 800 and tapered areas 820 and 821 are provided for use by a vertically polarized signal path portion to be coupled to polarization plate 800. Accordingly, tapered areas 810 and 811 provide tapered surfaces corresponding to a single interior wall of a rotator portion of a waveguide providing rotation from vertical to 45° slant right. Likewise, tapered areas 820 and 821 provide tapered surfaces corresponding to a single interior wall of a rotator portion of a waveguide providing rotation from horizontal to 45° slant right.

It shall be appreciated that although being significantly more complicated to manufacture than the flat face polarization plate described above, the tapered face polarization plate may provide a more subtle transition in polarization. Of course, both sides of the polarization plate may include tapered areas as described above, such as where the polarization plate is a separate component, if desired.

Figure 8:
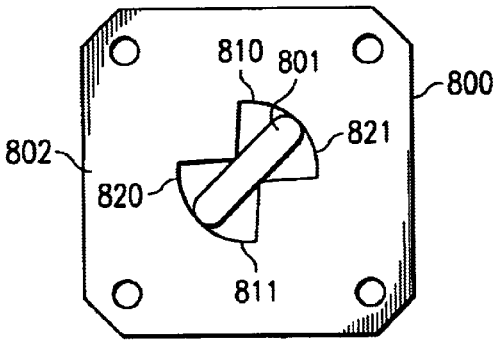
FIG. 8 illustrates an alternative embodiment of the polarization plate of the present invention having tapered areas to improve reflection characteristics.
Figure 9:
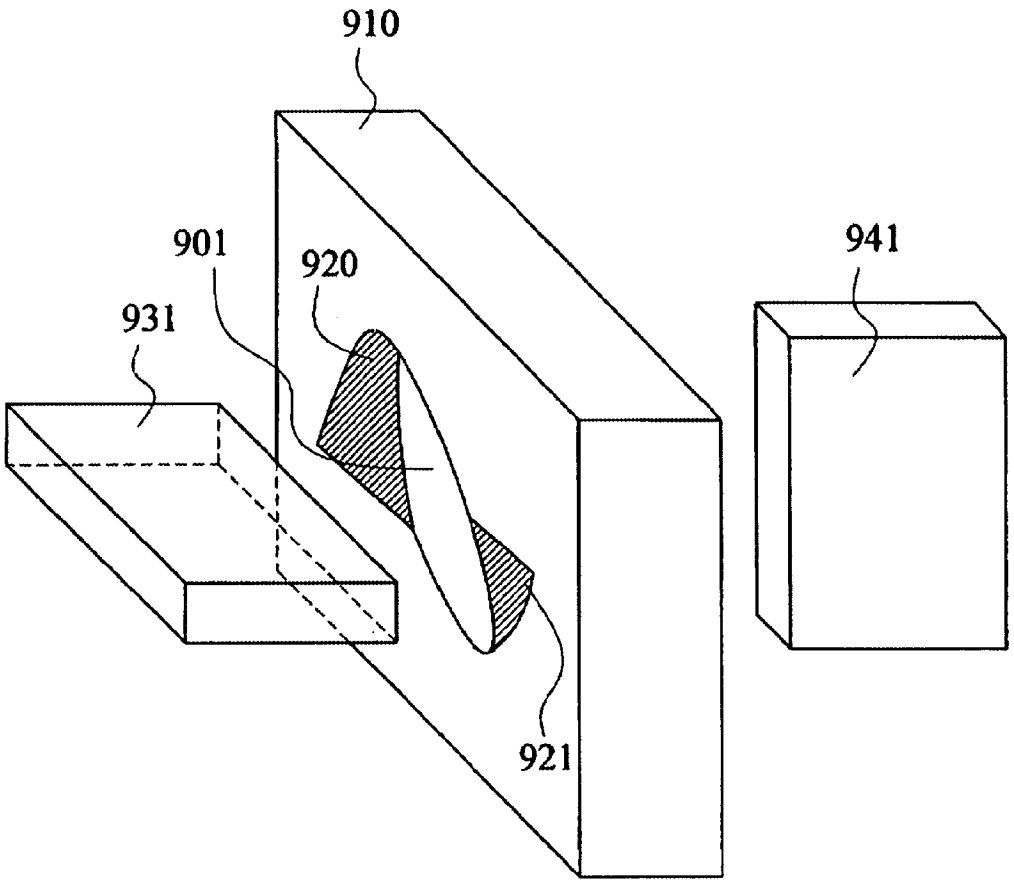
FIG. 9 depicts a three dimensional view of a simplified version, for clarity, of the alternative embodiment of the polarization plate illustrated in FIG. 8.

For example, FIG. 9 is a three-dimensional view of a simplified version of the polarization plate shown in FIG. 8. For clarity, only one set of tapered areas leading to the slit shown in FIG. 8 is depicted. It is to be understood that two sets of tapered areas may be provided on each side of the polarization plate. The polarization plate 910 is shown with one waveguide section 931 on one side of the polarization plate and another waveguide section 941 shown on the opposite side of the polarization plate. Typically, the waveguides 931 and 941 are either cross-polarized or co-polarized with respect to each other. It is to be understood that in operation, the waveguide sections would be joined with the polarization plate as discussed elsewhere in the application. The slit 901 through the polarization plate is shown with the tapered areas 920 and 921, which correspond to the tapered areas 820 and 821 depicted in FIG. 8. As previously discussed, the tapered areas 920 and 921 may provide a more subtle transition in polarization between the waveguide 931 and the slit 901.

As described above with respect to the preferred embodiment, the polarization plate of the present invention may provide a waveguide portion rather than simply a slit if desired. This waveguide portion may be of a particular length with respect to the propagated wavelength in order to provide impedance matching or other desired signal path characteristics. Additionally, a waveguide portion of the polarization plate of the present invention may be further adapted to provide desired characteristics such as presenting a waveguide of a different size in order to filter particular frequencies otherwise present in the propagated signal or including a tuning screw or waveguide plunger to adjust the impedance of the waveguide. Alternatively, the aforementioned wave guide portion may be omitted and a polarization plate of the present invention may be coupled directly to a transceiver or other equipment, if desired.

It shall be appreciated that, although described with reference to a transceiver unit, the adaptation of signal paths for accommodating dual polarization according to the present invention is not limited to signal paths associated with any particular portion of an information communication system. Likewise, although described with reference to a bi-directional signal path, it shall be appreciated that the present invention is useful in either a forward link signal path or a reverse link signal path alone.

Although the specific examples given above have been described with respect to the use of vertical and horizontal polarization, there is no such limitation to the present invention. For example, a polarization plate substantially as described above may be utilized to provide dual polarization for a slant right and slant left system where the slit of the polarization plate is either vertical or horizontal.

Although the present invention and its advantages have been described in detail, it should be understood that various changes, substitutions and alterations can be made herein without departing from the spirit and scope of the invention as defined by the appended claims.

What is claimed is:

1. A waveguide system for propagating a signal wherein said signal enters said waveguide system oriented with a first polarization and exits said waveguide system oriented with a second polarization, said waveguide system comprising:

a first waveguide adapted to be operatively connected to a polarization plate, said first waveguide comprising a first passage for propagating said signal through the first waveguide wherein said first passage is oriented substantially similar to the orientation of the signal when the signal is oriented with said first polarization;

a second waveguide adapted to be operatively connected to the polarization plate, said second waveguide comprising a second passage for propagating said signal through the second waveguide wherein said second passage is oriented substantially similar to the orientation of the signal when the signal is oriented with said second polarization; and a polarization plate adapted to be operatively connected to said first and second waveguides so as to allow for the propagation of the signal from the first waveguide where the signal is oriented with the first polarization, through said polarization plate, to the second waveguide where the signal is oriented with the second polarization, said polarization plate comprising:

a slot for propagating said signal wherein said slot is substantially similar in shape to said first passage and said second passage and wherein said slot is oriented so as to be rotationally offset, about an axis running longitudinally through the first and second passages and through said slot, from the orientation of the first passage and the orientation of the second passage, so that said signal enters the waveguide system oriented with said first polarization and exits said waveguide system with said second polarization;

wherein said polarization plate includes a first tapered portion to thereby create a first transition region between said first passage and said slot.

2. The waveguide system of claim 1 wherein said first polarization is substantially identical to said second polarization.

3. The waveguide system of claim 1 wherein said first polarization is substantially orthogonal to said second polarization.

4. The waveguide system of claim 1 wherein the amount of rotational offset of the slot in the polarization plate from the orientation of the first passage is substantially 45°.

5. The waveguide system of claim 1 wherein the rotational offset between said first passage and said slot is the same as the rotational offset between said slot and said second passage.

6. The waveguide system of claim 1 wherein said signal is a radio frequency signal in the range of 2 to 110 GHz.

7. The waveguide system of claim 1 wherein said signal is a radio frequency signal is in the microwave frequency range.

8. The waveguide system of claim 1 wherein said first passage is associated with a radio communication apparatus and said second passage is associated with an antenna.

9. The waveguide system of claim 8 wherein said antenna is a polarized antenna and the polarization of said polarized antenna is the same as the polarization of said second passage.

10. The waveguide system of claim 1 wherein said first passage is associated with an antenna and said second passage is associated with a radio communication apparatus.

11. The waveguide system of claim 10 wherein said antenna is a polarized antenna and the polarization of said polarized antenna matches the polarization of the first passage.

12. The waveguide system of claim 1 wherein said polarization plate further includes a second tapered portion to thereby create a second transition region between said slot and said second passage.

13. The waveguide system of claim 1 wherein the length of said slot along said longitudinal axis is selected so as to provide in a predetermined manner a desired signal path attribute.

14. The waveguide system of claim 13 wherein said signal path attribute includes a desired impedance.

15. The waveguide system of claim 1, wherein said slot is symmetric about a plane perpendicular to the axis.

16. The waveguide system of claim 1, wherein the slot intersecting a front face of the polarization plate is oriented so as to be rotationally offset, about the axis from the orientation of the first passage and the orientation of the second passage and the slot intersecting a rear face of the polarization plate is oriented so as to be rotationally offset, about the axis from the orientation of the first passage and the orientation of the second passage.

17. The waveguide system of claim 1, wherein said slot is symmetric about a plane which includes the axis.

* * * * *